US011841184B2

(12) United States Patent
Bischof

(10) Patent No.: US 11,841,184 B2
(45) Date of Patent: Dec. 12, 2023

(54) MOVABLE REFRIGERATOR ALLOWING BIDIRECTIONAL DOOR OPENING

(71) Applicant: LEISURE-TEC INTERNATIONAL LIMITED, Harbour (HK)

(72) Inventor: Andreas Bischof, Harbor (HK)

(73) Assignee: LEISURE-TEC INTERNATIONAL LIMITED, Harbour (HK)

( * ) Notice: Subject to any disclaimer, the term of this patent is extended or adjusted under 35 U.S.C. 154(b) by 632 days.

(21) Appl. No.: 17/079,886

(22) PCT Filed: Apr. 25, 2019

(86) PCT No.: PCT/CN2019/084258

§ 371 (c)(1),
(2) Date: Oct. 26, 2020

(87) PCT Pub. No.: WO2019/206220

PCT Pub. Date: Oct. 31, 2019

(65) Prior Publication Data

US 2021/0364222 A1 Nov. 25, 2021

(30) Foreign Application Priority Data

Apr. 27, 2018 (CN) ..... 201820622633.X

(51) Int. Cl.
*F25D 23/02* (2006.01)

(52) U.S. Cl.
CPC ..... *F25D 23/028* (2013.01); *F25D 23/026* (2013.01); *F25D 2323/022* (2013.01); *F25D 2400/10* (2013.01)

(58) Field of Classification Search
CPC ..... F25D 23/028; F25D 23/026; F25D 2323/022; F25D 2400/10; F25D 23/02
See application file for complete search history.

(56) References Cited

U.S. PATENT DOCUMENTS 4,503,582 A * 3/1985 Gurubatham ..... E05D 15/505 16/DIG. 23
4,947,583 A * 8/1990 Inui ..... F25D 23/02 49/382

(Continued)

FOREIGN PATENT DOCUMENTS

CN 2419552 Y 2/2001
CN 2684103 Y * 1/2004

(Continued)

OTHER PUBLICATIONS

English translation of CN-204787555-U (Year: 2023).*
English translation of CN-102493736-A (Year: 2023).*
English translation of CN-2684103-Y (Year: 2023).*

*Primary Examiner* — James N Smalley
(74) *Attorney, Agent, or Firm* — McNees Wallace & Nurick LLC

(57) ABSTRACT

Provided is a movable refrigerator allowing bidirectional door opening. The refrigerator comprises a refrigerator body and a refrigerator door, wherein the refrigerator door is detachably connected to the refrigerator body; door frames are provided at four corners of the refrigerator body, and convex door columns are fixedly provided at the door frames; mounting grooves are provided at two ends of one side of the refrigerator door, and accommodating grooves are provided at two ends of the corresponding side; and limiting protrusions are provided in the mounting grooves, and the door columns are clamped between the mounting grooves and the limiting protrusions, so that the refrigerator body and the refrigerator door are rotatably connected, and the door columns on the opposite sides are accommodated in the accommodating grooves. By providing the door columns on the front side and the rear side of the refrigerator body and also providing the mounting grooves and the accommodating grooves on the refrigerator door, the refrigerator (Continued)

door can be mounted on any lateral surface on the front side or the rear side, it is easy to detach the refrigerator door from the refrigerator body, and a user can change the opening direction of the refrigerator door at any time, thereby overcoming the defect of one-side door opening.

4 Claims, 4 Drawing Sheets

(56) References Cited

U.S. PATENT DOCUMENTS

| | | | | |
|---|---|---|---|---|
| 5,829,197 | A * | 11/1998 | Oh | E05D 15/505 16/231 |
| 6,073,789 | A | 6/2000 | Lundblade | |
| 10,590,686 | B2 * | 3/2020 | Zhang | F25D 23/028 |
| 2004/0000028 | A1 | 1/2004 | Kim | |

FOREIGN PATENT DOCUMENTS

| | | | | |
|---|---|---|---|---|
| CN | 102493736 | A | * | 6/2012 |
| CN | 102493736 | A | | 6/2012 |
| CN | 103743190 | A | | 4/2014 |
| CN | 204787555 | U | * | 11/2015 |
| CN | 208312809 | U | | 1/2019 |
| EP | 0807740 | B1 | | 7/2004 |
| GB | 2107768 | A | | 5/1983 |
| KR | 930015224 | U | | 7/1993 |

* cited by examiner

MOVABLE REFRIGERATOR ALLOWING BIDIRECTIONAL DOOR OPENING

TECHNICAL FIELD

The present application relates to the technical field of mobile refrigerators, and more specially, relates to a movable refrigerator allowing bidirectional door opening.

BACKGROUND

The existing mobile refrigerator has a door shaft or door column on only one side, so the door can only be opened to one side. When the mobile refrigerator is used in a relatively narrow environment, opening the door on one side will cause inconvenience to the user, so movable refrigerators allowing bidirectional door opening become a demand in some specific environments.

Technical Problem

The technical problem to be solved by the present application is to provide a movable refrigerator allowing bidirectional door opening, the door of which is easy to disassemble, and the door columns on both sides are arranged on the box body and a user can change the opening direction of the refrigerator door at any time, thereby overcoming the defect of one-side door opening.

Technical Solution

The technical solution of the present application is as follows: the present application provides a movable refrigerator allowing bidirectional door opening, comprises a refrigerator body and a refrigerator door, wherein the refrigerator door is detachably connected to the refrigerator body; door frames are provided at four corners of the refrigerator body, and convex door columns are fixedly provided at the door frames; mounting grooves are provided at two ends of one side of the refrigerator door, and accommodating grooves are provided at two ends of the corresponding side; and limiting protrusions are provided in the mounting grooves, and the door columns are clamped between the mounting grooves and the limiting protrusions, so that the refrigerator body and the refrigerator door are rotatably connected, and the door columns on the opposite sides are accommodated in the accommodating grooves.

Further, the refrigerator door is provided with a door buckle on one side which is provided with accommodating grooves, two sides of the refrigerator body are both provided with buckle holes.

Further, diameters of the mounting grooves and the accommodating grooves are both larger than diameters of the door columns; a slotting direction of the mounting grooves is horizontal direction, and a slotting direction of the accommodating grooves is vertical direction.

Further, the door frames and the refrigerator body are connected by means of bolts.

Further, the limiting protrusion is an arc-shaped protrusion.

BENEFICIAL EFFECTS

The movable refrigerator allowing bidirectional door opening has the following beneficial effects: by providing the door columns on the front side and the rear side of the refrigerator body and also providing the mounting grooves and the accommodating grooves on the refrigerator door, the refrigerator door can be mounted on any lateral surface on the front side or the rear side, it is easy to detach the refrigerator door from the refrigerator body, and a user can change the opening direction of the refrigerator door at any time, thereby overcoming the defect of one-side door opening.

BRIEF DESCRIPTION OF THE DRAWINGS

The present application will be further described below in conjunction with the drawings and embodiments, in the drawings.

DETAILED DESCRIPTION OF THE PREFERRED EMBODIMENT

Figure 1:
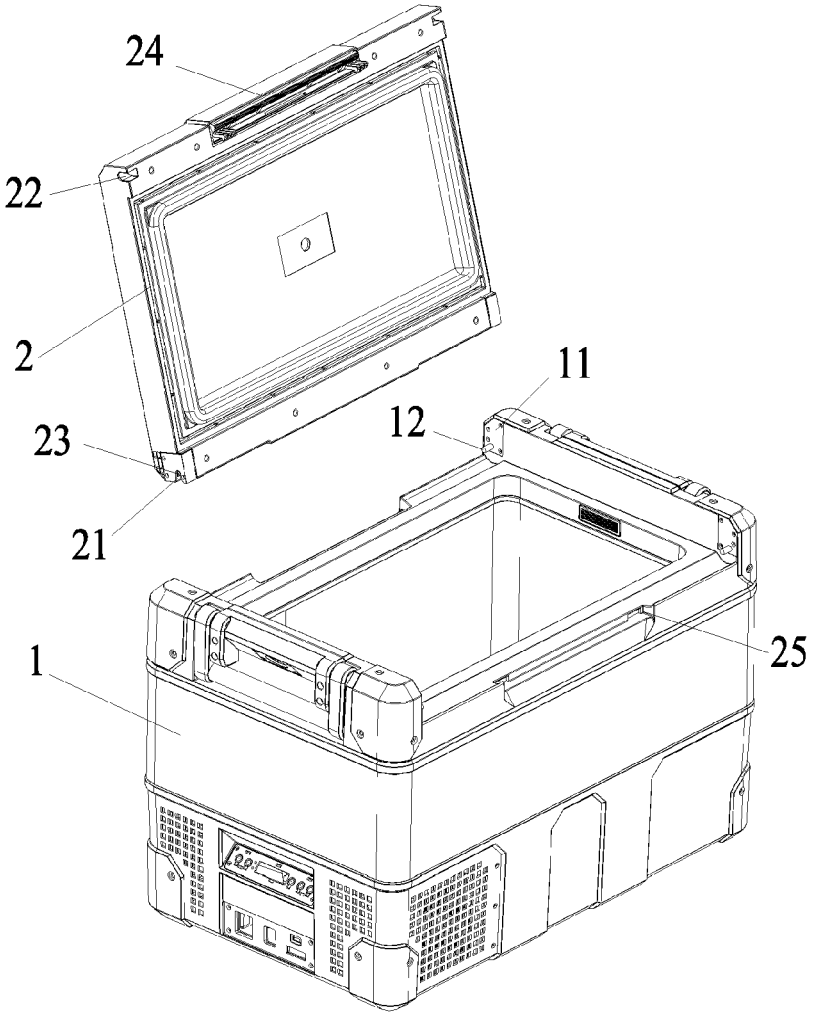
FIG. 1 is the split structure diagram of the movable refrigerator allowing bidirectional door opening of the present application.
Figure 2:
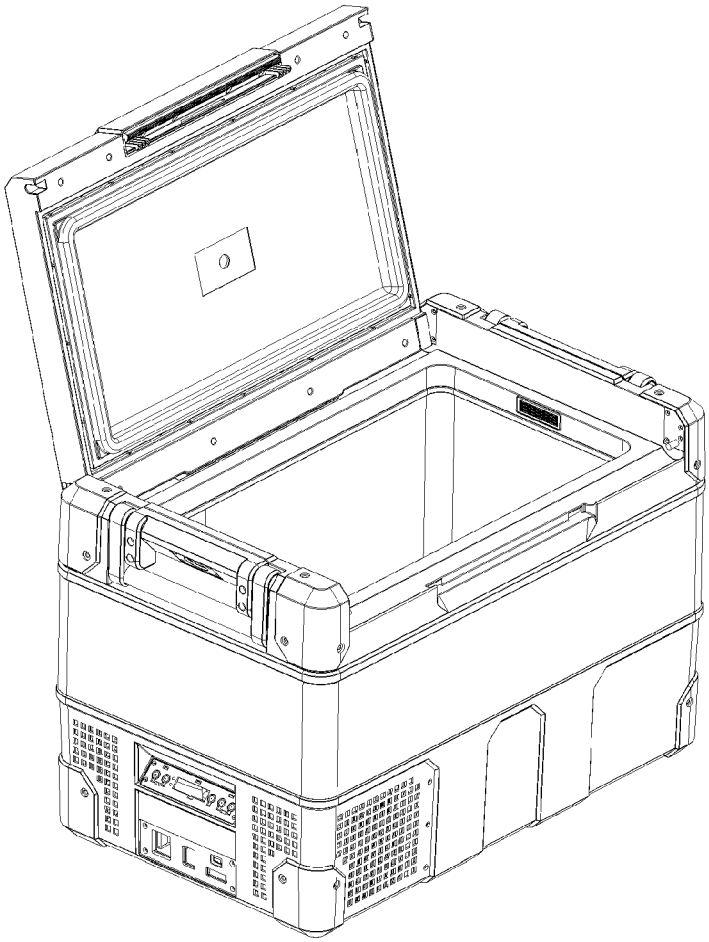
FIG. 2 is the structure diagram of the movable refrigerator allowing bidirectional door opening of the present application when the refrigerator door installed at the rear.
Figure 3:
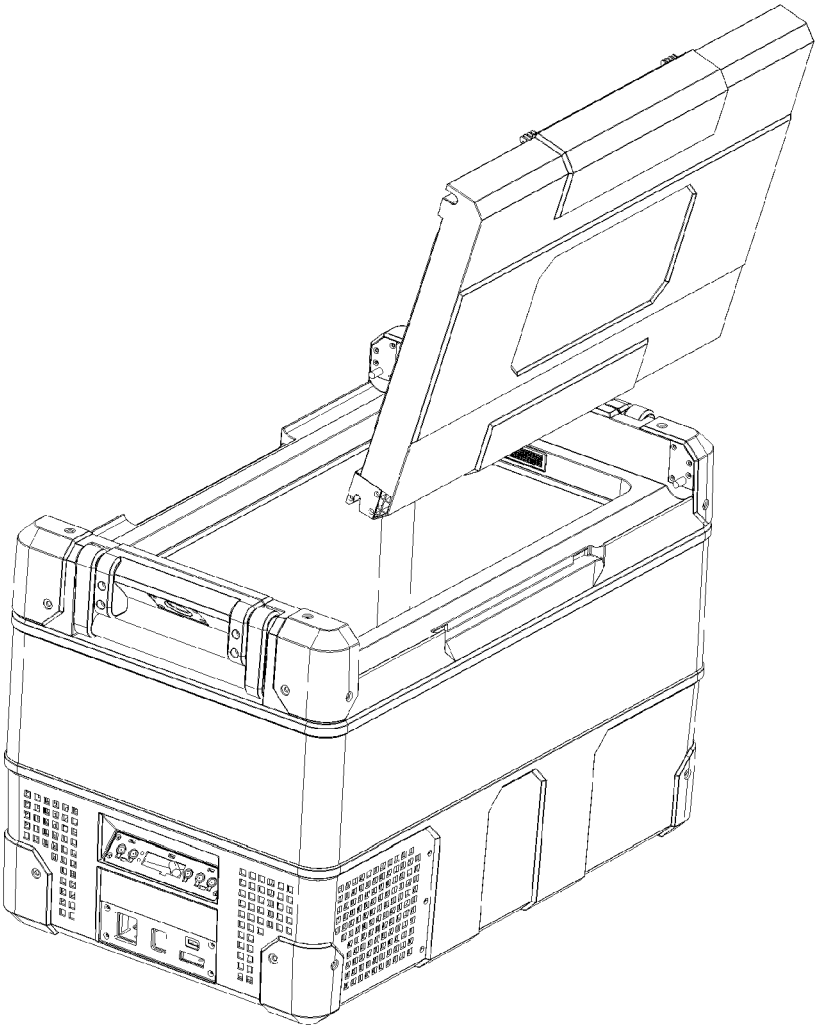
FIG. 3 is the structure diagram of the movable refrigerator allowing bidirectional door opening of the present application before the refrigerator door is installed.
Figure 4:
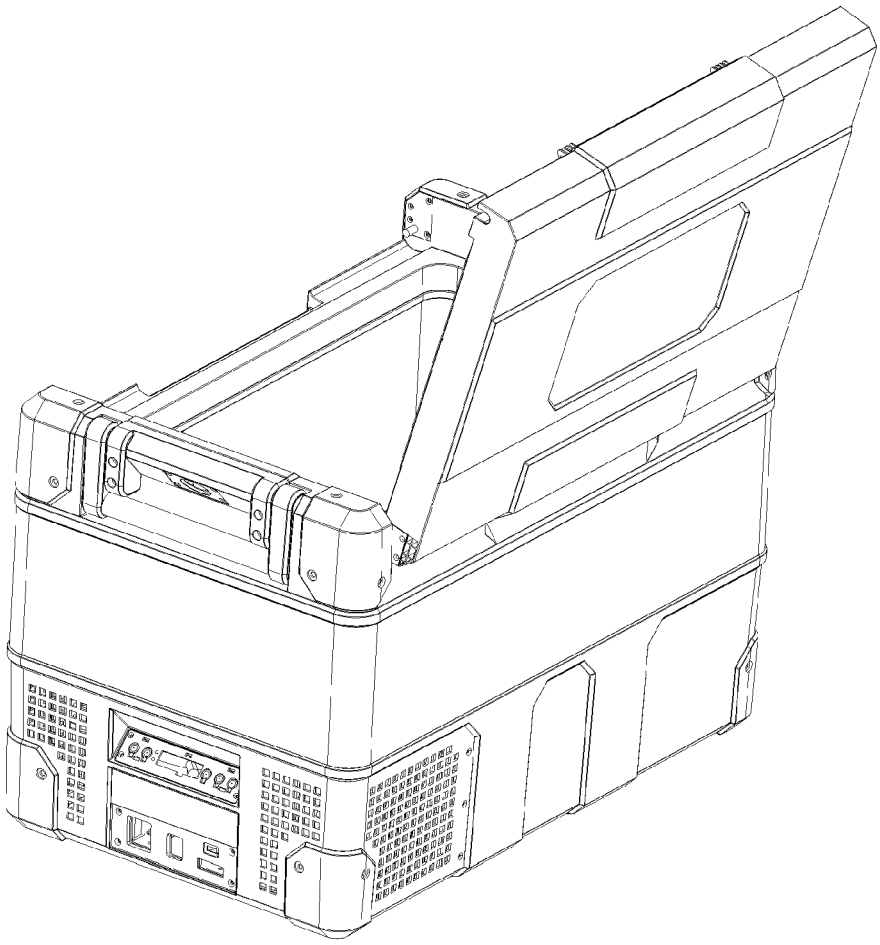
FIG. 4 is the structure diagram of the movable refrigerator allowing bidirectional door opening of the present application when the refrigerator door installed in front.

FIGS. 1 to 4 show a preferred embodiment of the movable refrigerator allowing bidirectional door opening of the present application, which comprises a refrigerator body 1 and a refrigerator door 2, wherein the refrigerator door 2 is detachably connected to the refrigerator body 1; door frames 11 are provided at four corners of the refrigerator body 1, and convex door columns 12 are fixedly provided at the door frames 11; mounting grooves 21 are provided at two ends of one side of the refrigerator door 2, and accommodating grooves 22 are provided at two ends of the corresponding side; and limiting protrusions 23 are provided in the mounting grooves 21, and the door columns 12 are clamped between the mounting grooves 21 and the limiting protrusions 23, so that the refrigerator body 1 and the refrigerator door 2 are rotatably connected, and the door columns 12 on the opposite sides are accommodated in the accommodating grooves 22. On the common mobile refrigerator, only one side is provided with door frames 11, door columns 12 and mounting grooves 21. In order to realize the function of double side door opening, in this embodiment, door columns 12 are set at four corners of the refrigerator body 1, so that the refrigerator door 2 can be installed at the front or rear side of the refrigerator according to the use situation, and the extra group of door columns 12 will collide with the refrigerator door 2. Therefore, accommodating grooves 22 are arranged on the opposite side of the mounting grooves 21 to accommodate the protruding door columns 12 to realize the bidirectional door opening. The mounting groove 21 is an arc-shaped grooves, which is provided with a limiting protrusion 23, which is an arc-shaped protuberance. The door column 12 is stuck between the limiting protrusion 23 and the mounting groove 21. If the door is opened with a larger force, the door column 12 will break free from the mounting groove 21. The refrigerator door 2 in the embodiment is convenient for installation and disassembly, and also convenient for the user to select the opening direction at any time.

In the embodiment, the refrigerator door 2 is provided with a door buckle 24 on one side which is provided with accommodating grooves 22, two sides of the refrigerator body 1 are both provided with buckle holes 25. The door buckle 24 is elastically connected with the refrigerator door 2, which is used to close the refrigerator door 2. Two buckle holes 25 are symmetrically arranged on both sides of the refrigerator body 1, and the position of the buckle hole 25 corresponds to the door buckle 24. The door buckle 24 is buckled into the buckle hole 25 to complete the closing of the refrigerator door. Press the door buckle 24, under the action of the spring, the door buckle 24 shrinks and pulls out from the buckle hole 25, and the refrigerator door opens.

In the embodiment, diameters of the mounting grooves 21 and the accommodating grooves 22 are both larger than diameters of the door columns 12, so that the door columns 12 can be stuck in the mounting grooves 21 and the accommodating grooves 22 when installing the refrigerator door; a slotting direction of the mounting grooves 21 is horizontal direction, and a slotting direction of the accommodating grooves 22 is vertical direction. This setting is in line with the change of the rotation angle when opening the door. The refrigerator door 2 can rotate from the horizontal direction to the vertical direction, and the rotation angle of the refrigerator door 2 is 90 degrees.

In the movable refrigerator allowing bidirectional door opening, by providing the door columns on the front side and the rear side of the refrigerator body and also providing the mounting grooves and the accommodating grooves on the refrigerator door, the refrigerator door can be mounted on any lateral surface on the front side or the rear side, it is easy to detach the refrigerator door from the refrigerator body, and a user can change the opening direction of the refrigerator door at any time, thereby overcoming the defect of one-side door opening.

The above content is only a prefer embodiment of the present application. For ordinary technical personnel in the field, according to the idea of the present application, many changes can be made in the specific implementation mode and application scope. As long as these changes do not deviate from the concept of the present application, they belong to the protection scope of the present application.

The invention claimed is:

1. A movable refrigerator allowing configured for bidirectional door opening, comprising:

a refrigerator body and a refrigerator door, wherein the refrigerator door is detachably connected to the refrigerator body;

wherein door frames are provided at four corners of the refrigerator body, and convex door columns are fixedly provided at the door frames;

wherein mounting grooves are provided at two ends of one side of the refrigerator door, and accommodating grooves are provided at two ends of the corresponding side; and wherein limiting protrusions are provided in the mounting grooves, and the door columns are clamped between the mounting grooves and the limiting protrusions, so that the refrigerator body and the refrigerator door are rotatably connected, wherein the door columns on the opposite sides are accommodated in the accommodating grooves, and wherein the refrigerator door is provided with a door buckle on one side which is provided with accommodating grooves, wherein two sides of the refrigerator body are both provided with buckle holes.

2. A movable refrigerator configured for bidirectional door opening, comprising:

a refrigerator body and a refrigerator door, wherein the refrigerator door is detachably connected to the refrigerator body;

wherein door frames are provided at four comers of the refrigerator body, and convex door columns are fixedly provided at the door frames;

wherein mounting grooves are provided at two ends of one side of the refrigerator door, and accommodating grooves are provided at two ends of the corresponding side;

wherein limiting protrusions are provided in the mounting grooves, and the door columns are clamped between the mounting grooves and the limiting protrusions, so that the refrigerator body and the refrigerator door are rotatably connected, wherein the door columns on the opposite sides are accommodated in the accommodating grooves, wherein diameters of the mounting grooves and the accommodating grooves are both larger than diameters of the door columns; and wherein a slotting direction of the mounting grooves is horizontal, and a slotting direction of the accommodating grooves is vertical.

3. The movable refrigerator according to claim 1, wherein, the door frames and the refrigerator body are connected by fastener.

4. The movable refrigerator according to claim 1, wherein the limiting protrusion is an arc-shaped protrusion.

* * * * *